United States Patent [19]

Kabeya

[11] Patent Number: 4,936,117

[45] Date of Patent: Jun. 26, 1990

[54] WASHING APPARATUS

[75] Inventor: Katsuhei Kabeya, Aichi, Japan

[73] Assignee: Tokyo Shibaura Denki Kabushiki Kaisha, Kawasaki, Japan

[21] Appl. No.: 801,388

[22] Filed: Nov. 25, 1985

Related U.S. Application Data

[63] Continuation of Ser. No. 441,866, Nov. 15, 1982, abandoned.

[30] Foreign Application Priority Data

Nov. 17, 1981 [JP] Japan ..... 56-184752

[51] Int. Cl.[5] ..... D06B 37/26

[52] U.S. Cl. ..... 68/3 R; 68/23 R; 248/678; 248/188.1; 312/228; 312/257.1

[58] Field of Search ..... 68/3 R, 23 R, 23 B; 312/228, 253, 257 SM, 257 A; 248/678, 188.1, 340

[56] References Cited

U.S. PATENT DOCUMENTS

| | | | |
|---|---|---|---|
| 1,473,130 | 11/1923 | Voss | 68/3 R |
| 1,790,584 | 1/1931 | Hirschy | 68/3 R |
| 1,847,204 | 3/1932 | Altorfer | 68/3 R |
| 1,854,745 | 4/1932 | Keltie | 68/3 R |
| 2,050,617 | 8/1936 | Litner | 312/228 |
| 2,146,939 | 2/1939 | Coordes | 312/228 X |
| 2,215,952 | 9/1940 | Beckman | 68/3 R X |
| 2,272,517 | 2/1942 | Frantz et al. | 68/3 R |
| 3,039,284 | 6/1962 | Shelton et al. | 68/3 R |
| 3,581,527 | 6/1971 | Smith et al. | 68/3 R X |
| 4,236,771 | 12/1980 | Summers | 312/228 |

FOREIGN PATENT DOCUMENTS

| | | | |
|---|---|---|---|
| 1309331 | 10/1962 | France | 312/228 |
| 47-23401 | 7/1972 | Japan . | |
| 696603 | 9/1953 | United Kingdom | 68/23 R |
| 966231 | 8/1964 | United Kingdom | 68/3 R |

*Primary Examiner*—Frankie L. Stinson

*Attorney, Agent, or Firm*—Cushman, Darby & Cushman

[57] ABSTRACT

A washing apparatus comprises a pedestal, drive device fitted to the pedestal, a tub body provided with a washing tank, two elongate fitting legs fitted to the tub body at one end and attached to the pedestal at the other end, thereby supporting the tub body above the pedestal at a prescribed distance, and an outer casing which is detachably fitted to the fitting legs to enclose the drive device and tub body.

8 Claims, 4 Drawing Sheets

WASHING APPARATUS

This is a continuation of application Ser. No. 441,866, filed Nov. 15, 1982, which was abandoned upon the filing hereof.

BACKGROUND OF THE INVENTION

This invention relates to a washing apparatus. Hitherto, a washing apparatus, for example, a 2-tank type provided with a washing tank and a dehydrating tank generally comprises a pedestal fitted with, for example, a motor, an outer casing of substantially square tubular shape fixed to the pedestal to be closed at one end with the pedestal, and a tub body inserted into the outer casing through the open end of the outer casing and supported by the outer casing, the tub body provided with a washing tank and dehydrating tank. The outer casing has a maintenance opening which is formed in back side wall of the outer casing and normally covered with a detachable plate.

The above-mentioned type of washing apparatus is constructed by the steps of fixing the outer casing to the pedestal; fitting the tub body previously provided inside with stirring blades to the outer casing; stretching a belt for connecting the stirring blades to the motor; and connecting leads to the prescribed terminals. The two last steps are taken by inserting hands to the depth of the outer casing through the maintenance opening. Therefore, the conventional washing apparatus has the drawback that difficulties arise in the assembly of the apparatus and the exchange of its parts.

SUMMARY OF THE INVENTION

This invention has been accomplished in view of the above-mentioned circumstances and is intended to provide a washing apparatus which can be easily assembled and facilitate the exchange of parts.

To attain the above-mentioned object, this invention provides a washing apparatus which comprises: a pedestal; drive means fitted to the pedestal; a tub body provided with a washing tank; two elongate fitting legs, each of which is fitted to the tub body at one end and attached to the pedestal at the other end thereby to support the tub body above the pedestal at a predetermined distance; and an outer casing which is detachably attached to the fitting legs or pedestal to enclose the drive means and tub body.

The above-mentioned washing apparatus embodying this invention comprises two fitting legs supporting the tub body in a state positioned above the pedestal at a prescribed distance. With the subject washing apparatus, therefore, various operations, for example, the assembly and exchange of parts can be effected under the condition where the outer casing is taken off, namely, no obstructions are present around the tub body, thus with greater ease than in the case of the conventional washing apparatus.

DETAILED DESCRIPTION OF THE PREFERRED EMBODIMENTS

Figure 1:
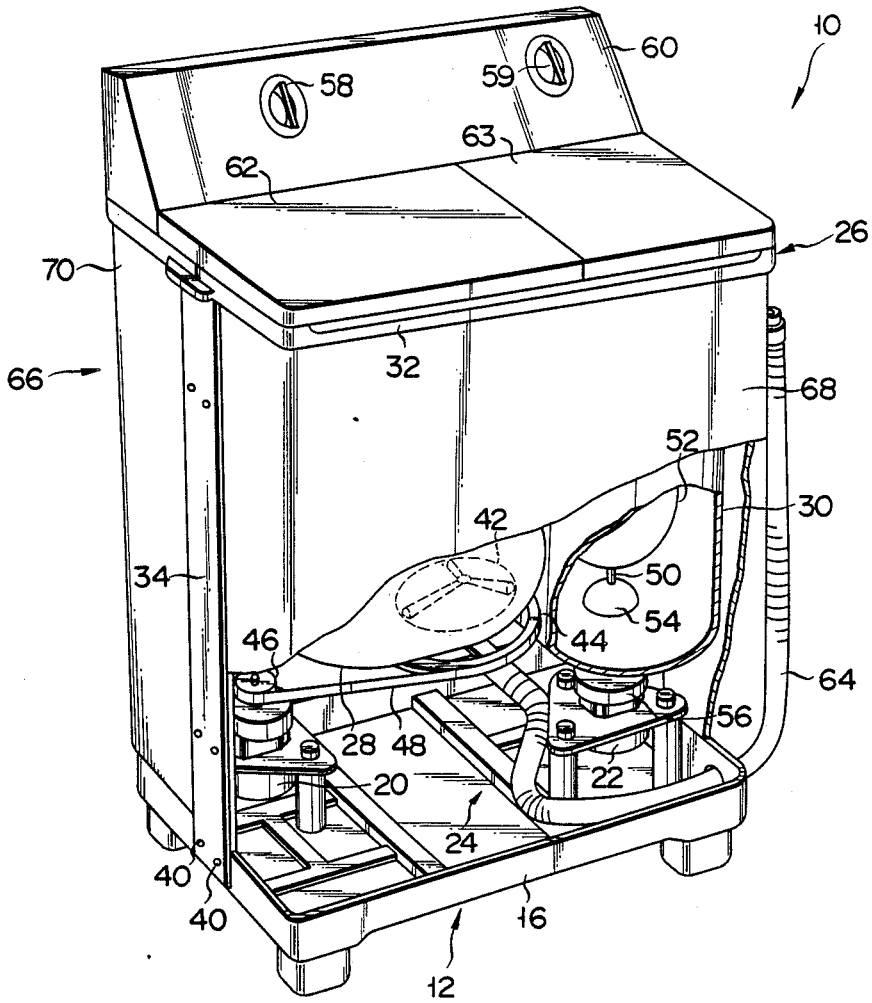
FIG. 1 is a partly cutaway perspective view of a washing apparatus according to a first embodiment of this invention.
Figure 2:
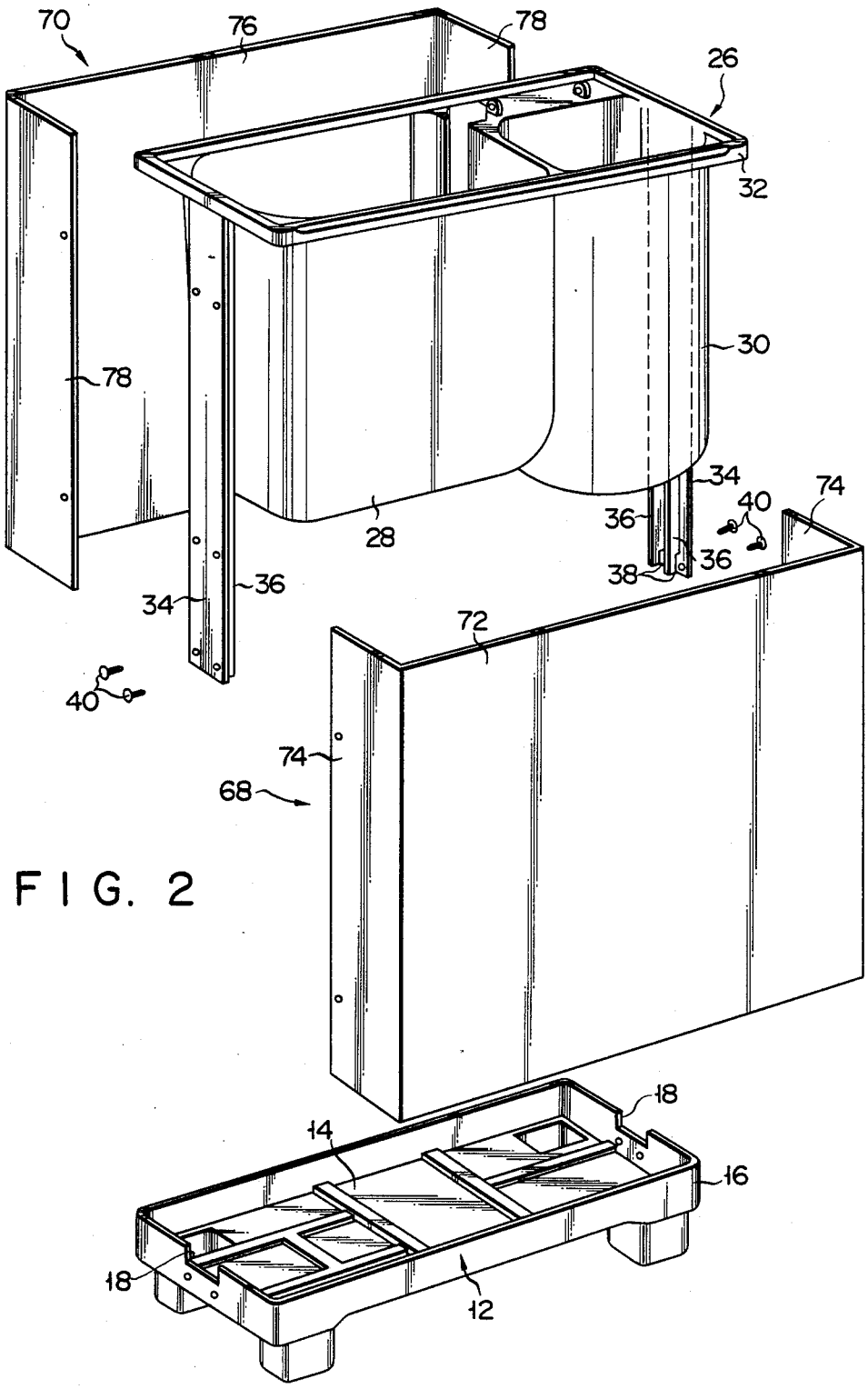
FIG. 2 is an exploded perspective view of the washing apparatus of FIG. 1.

Description is now given with reference to FIGS. 1 and 2 of a washing apparatus according to a first embodiment of this invention. As seen from FIGS. 1 and 2, a two tank type washing apparatus 10 is provided with a pedestal 12. This pedestal 12 comprises a substantially rectangular bottom wall 14 and peripheral wall 16 erected along the edge of the bottom wall 14. As shown in FIG. 2, a pair of engagement notches 18 are formed in the upper portions of the two shorter mutually facing end portions of the peripheral wall 16 of the rectangular pedestal 12. The bottom wall 14 is fitted with a motor 20 used in a washing operation and a motor 22 used in a dehydrating operation. Both motors 20, 22 constitute part of the drive means 24 of the washing apparatus according to the first embodiment of this invention. The washing apparatus 10 is provided with a tub body 26. The tub body 26 includes a washing tank 28 and dehydrating tank 30. These tanks 28, 30 each made into a substantially cylindrical form are set in parallel, and are open at one end, and closed with a bottom wall at the other end. A rectangular flange 32 is formed along the peripheral edge of the opening of these tanks 28, 30. The washing tank 28, dehydrating tank 30 and flange 32 are integrally prepared from synthetic resin. The flange 32 has an outer peripheral shape having substantially the same size as that of the peripheral wall 16 of the pedestal 12.

The washing apparatus 10 is provided with plural, for example, two fitting legs 34 supporting the tub body 26 above the pedestal 12 at a prescribed distance. Each fitting leg 34 is made into a elongate flat plate and fixed to the tub body 26 at the upper end and attached to the pedestal 12 at the lower end. The fitting legs 34 are fixed at the upper end to the two shorter mutually facing end portions of the rectangular flange 32 to extend downward in parallel from the flange 32 to the pedestal 12. The fitting legs 34 extend to a prescribed extent below the bottom of the washing tank 28 and dehydrating tank 30. With the above-mentioned first embodiment, the fitting legs 34 are integrally formed with the tub body 26. A pair of reinforcement ribs 36 are fitted to the inside of each fitting leg 34 in a state lengthwise extending from the upper end of the fitting leg 34 to the lower end thereof. A downward open engagement groove 38 is formed in the lower end of the paired reinforcement ribs 36. The lower end of the fitting leg 34 is fixed to the pedestal 12 by fitting the wall of the engagement notch 18 of the pedestal 12 into the engagement grooves 38 of the paired reinforcement ribs 36 and further securing the lower end of the fitting leg 34 to the peripheral wall 16 of the pedestal 12 by means of screws 40 (FIG. 2). As a result, the paired fitting legs 34 support the tub 26 above the pedestal 12 at a prescribed distance.

A pulsator 42 is rotatably fitted to the inner bottom wall of the washing tank 28. The shaft (not shown) of the pulsator 42 extends downward through the washing tank 28. A driven pulley 44 is fitted to the lower end of the shaft of the pulsator 42. The drive pulley 46 is fitted to the rotary shaft of the motor 20. A belt 48 is stretched between the drive pulley 46 and driven pulley 44. A dehydrating cage 52 is rotatably supported in the dehydrating tank 30 by means of a shaft 50. This shaft 50 extends downward through the bellows 54 fixed to the inner bottom wall of the dehydrating tank 30 and said dehydrating tank 30 itself, and is further connected to the rotary shaft (not shown) of the motor 22 through a coupling device 56. On the upper rear side of the tub body 26 is mounted an operation box 60 which is provided with operation switches 58, 59, etc. Caps 62 and 63 are arranged on the upper front side of the tub body 26, respectively to close the openings of the washing tank 28 and dehydrating tank 30. A reference numeral 64 denotes a drainage pipe communicating with the washing tank 28 and dehydrating tank 30.

The subject washing apparatus 10 comprises an outer casing 66, which is detachably fitted to the fitting legs 34 to enclose the drive means 24 and tub body 26 and support the tub body 26 above the pedestal 12. The outer casing 66 includes a front frame 68 and rear frame 70. The front frame 68 consists of a front panel 72 constituting the front side of the outer casing 66 and a pair of side panels 74 constituting the front half portions of the side walls of the outer casing 66. The front frame 68 is constructed by bending a single plate member with a channel shaped cross section. The rear frame 70 has a rear panel 76 constituting the rear side of the outer casing 66 and a pair of side panels 78 constituting the rear half portions of the side walls of the outer casing 66. The rear frame 70 is constructed by bending a single plate member with a channel-shaped cross section. Both front frame 68 and rear frame 70 are made into the same shape to allow for their interchangeability. The front and rear frames 68, 70 are detachably attached to the fitting legs 34 by causing the edges of the side panels 74, 78 to be screwed to the fitting legs 34. Both front and rear frames 68, 70 cooperate to enclose the drive means 24 and tub body 26. The upper edges of the front and rear frames 68, 70 are pressed against the flange 32 of the tub body 26. The lower edges of both frames 68, 70 are pressed against the peripheral wall 16 of the pedestal 12. As a result, the outer casing 66 as well as fitting legs 34 support the tub body 26 above the pedestal 12 at a prescribed distance.

Description is now given of the sequential steps of assembling the washing apparatus 10 having the above-mentioned construction. First the drive means 24 and coupling device 56 are fitted to the inner bottom wall 14 of the pedestal 12. The tub body 26 is securely fixed above the pedestal 12 by means of the fitting legs 34 integrally formed with the tub body 26. Under this condition, the tub body 26 is stably supported by the fitting legs 34 and no members are provided around the tub body 26 other than the fitting legs. The operation box 60 is fitted to the tub body 26. The belt 48 is stretched between the drive pulley 46 of the motor 20 and the driven pulley 44 of the pulsator 42. The shaft 50 and the rotary shaft of the motor 22 are connected together by the coupling device 56. The leads drawn out from the operation box 60 are connected to the leads (not shown) drawn out from the motor 20 and 22. After completion of the above-mentioned steps, the front frame 68 and rear frame 70 are fixed to the fitting legs 34, thereby completing the assembly of the subject washing apparatus 10.

As described above, the washing apparatus 10 according to the first embodiment of this invention comprises two fitting legs for supporting the tub body 26 above the pedestal 12 at a prescribed distance. Therefore, the tub body 26 alone can be set above the pedestal 12, before the tub body 26 is enclosed in the outer casing 66. Consequently the aforementioned various assembling steps can be taken under the condition where no obstructions are present around the tub body 26, thereby prominently improving the assembling efficiency. Further where, for example, the motor 20 which has failed is exchanged for a new one, said exchange can be efficiently carried out under the condition where the outer casing 66 is taken off. The subject washing apparatus 10 provided with the fitting legs 34 has greater mechanical strength than the conventional washing apparatus in which the tub body is supported by the outer casing.

The foregoing embodiment refers to the case where the tub body 26 was supported above the pedestal 12 by means of two fitting legs 34. However, this invention is not limited to this arrangement. Namely, it is possible, as in the second embodiment shown in FIGS. 3 and 4, to let the tub body 26 be provided with not only two fitting legs 34 on the right and left sides but also two fitting legs 80 on the front and rear sides thereby to securely support the tub body 26 by four fitting legs above the pedestal 12. The additional fitting legs 80 are each provided with a pair of reinforcement ribs 82 like the previously described fitting legs 34. An engagement groove 84 is formed in the lower end of the reinforcement rib 82. A pair of engagement notches 86 are formed in the upper portion of those parts of the peripheral wall 16 of the pedestal 12 which face the fitting legs 80. The parts of the FIGS. 3 and 4 the same as those of FIGS. 1 and 2 are denoted by the same numerals.

Figure 3:
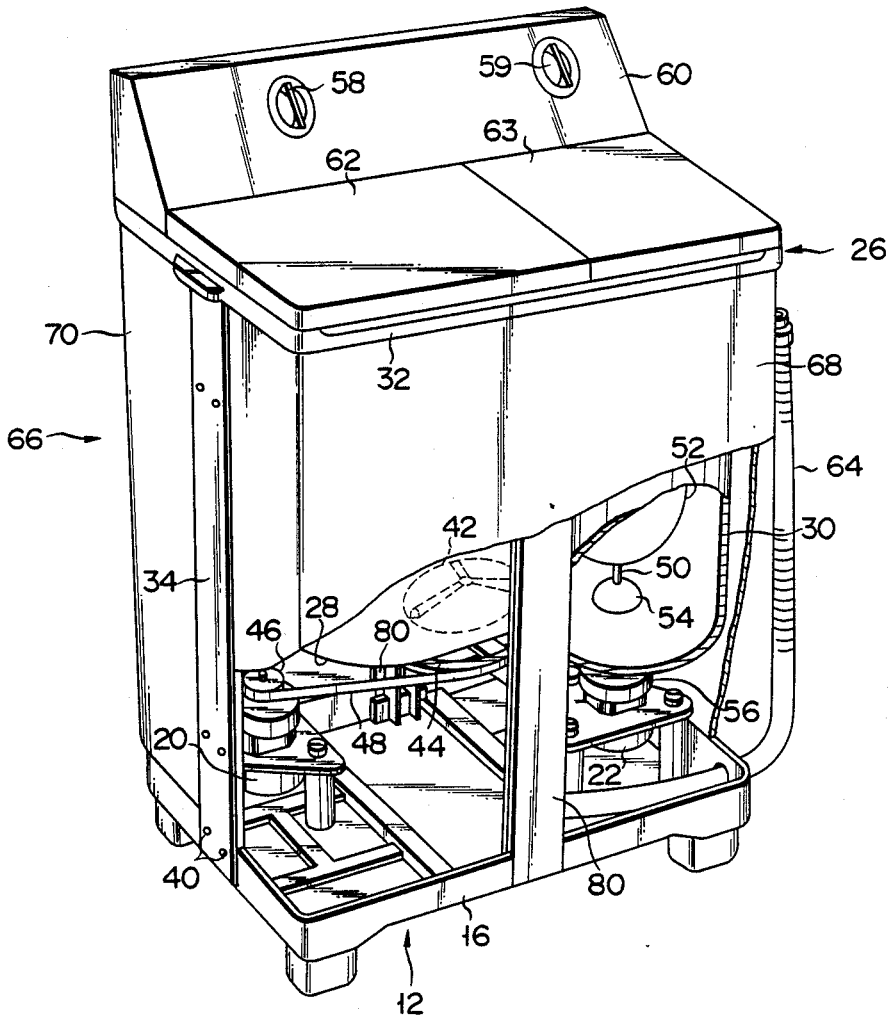
FIG. 3 is a partly cutaway perspective view of a washing apparatus according to a second embodiment of the invention.
Figure 4:
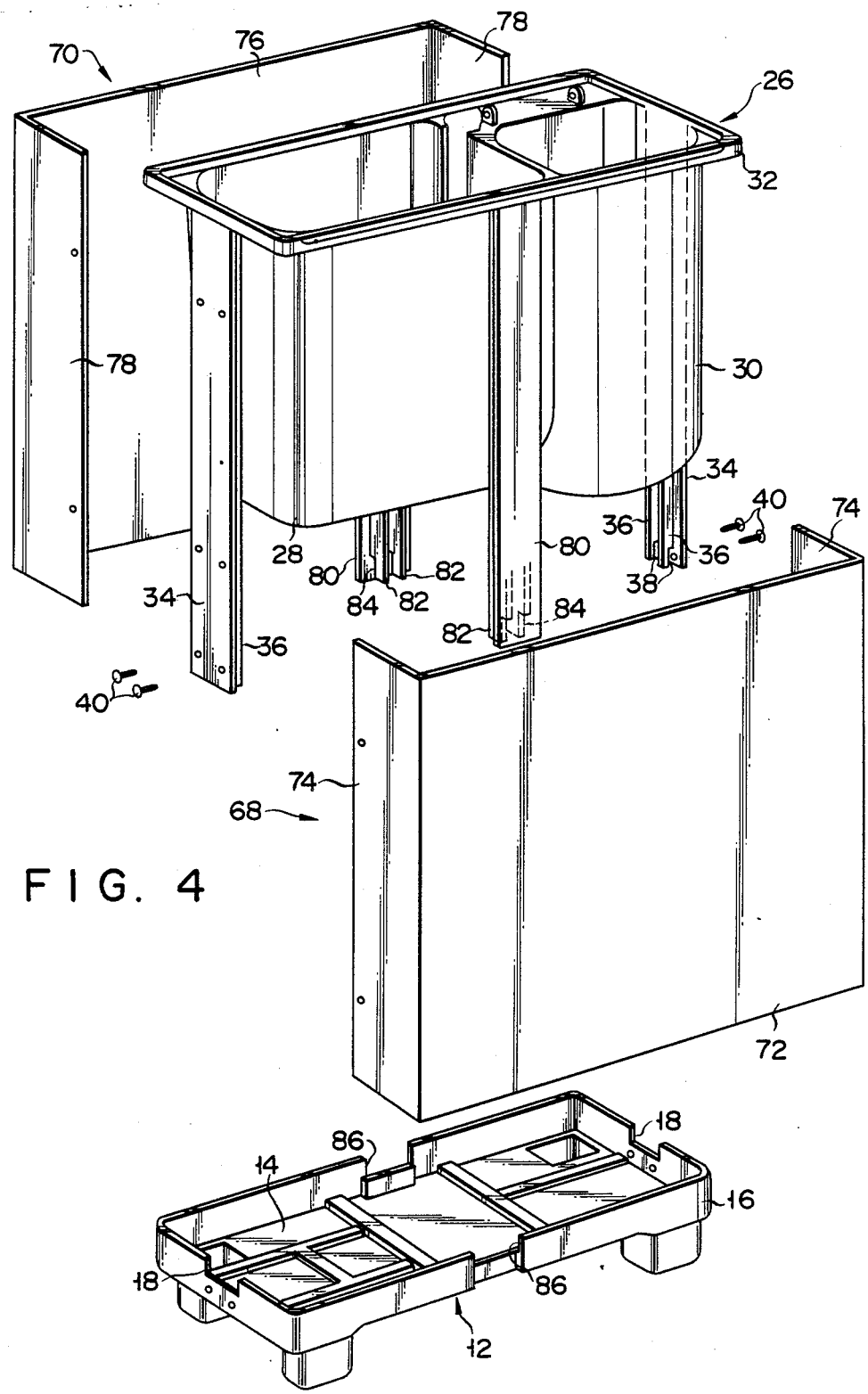
FIG. 4 is a exploded perspective view of the washing apparatus of FIG. 3.

The second embodiment of FIGS. 3 and 4 enables the tub body 26 to be more securely fixed above the pedestal 12 than the first embodiment of FIGS. 1 and 2. Therefore, the second embodiment allows for the trial run of the subject washing apparatus by rotating the pulsator 42 while the washing tank 28 is filled with water. Consequently the second embodiment enables various maintenance or final adjusting operations to be made. If, as seen from FIG. 3, the fitting legs 80 are set inside of the outer casing 66, the external appearance of the washing apparatus 10 is not obstructed by the fitting legs 80.

In the above-mentioned two embodiments, the outer casing consisted of two divides parts. However, the same effect can be assumed even if the outer casing is made into a single cylindrical body having a substantially square cross section. The outer casing may be detachably fitted to the pedestal. Further, the number of fitting legs need not be limited to two or four. The number can be changed as need arises, provided the tub body 26 can be securely supported above the pedestal 12. A washing apparatus embodying this invention need not be limited to the two tanks type, but may be applied to any other type, for example, a single tank type.

What is claimed is:

1. A washing apparatus comprising:

a pedestal defining a peripheral edge;

a tube body including a washing tank;

a single pair of elongated fitting leg means, each of said fitting leg means being fixed to the body at one end and to the pedestal at the other end, for supporting said tub body above said pedestal to establish a space between said washing tank and said pedestal, each of said fitting leg means being disposed on a respective one of two lateral sides of the washing apparatus opposing each other;

outer casing means, including front and rear U-shaped casing members each having a first wall and an integral pair of side walls, each said side wall being engageable with a respective one of said pair of leg means so that said front and rear casing members together with said pair of leg means substantially conform to said peripheral edge of said pedestal, said outer casing means for enclosing said space when said front and rear casing members are engaged with said pair of leg means and for permitting access to said space upon removal of said front or rear casing members while said tube means remains supported above said pedestal by said leg means, and means for removably fixing each said side wall to a respective one of said pair of leg means, whereby said washing apparatus is relatively economical to manufacture and relatively simple to service.

2. The washing apparatus according to claim 1, wherein said pedestal includes a bottom wall fitted with the drive means, a peripheral wall erected along the outer edge of the bottom wall, and engagement portions formed in the peripheral wall and to which the fitting legs are attached at the other end.

3. The washing apparatus according to claim 2, wherein said washing tank is made into a substantially cylindrical body open at one end and closed at the other end; the tub body has a dehydrating tank which is made into a substantially cylindrical body open at one end and closed at the other end and is positioned adjacent to the washing tank, and a flange formed along the peripheral edge of the opening of the washing tank and that of the dehydrating tank; and the washing tank, dehydrating tank and flange are integrally formed of synthetic resin.

4. The washing apparatus according to claim 3, wherein said fitting legs are fixed to the flange of the tub body at one end and extend from the flange to the pedestal in a mutually facing state, and the other end of the fitting leg is spaced from the bottoms of the washing tank and dehydrating tank at a prescribed distance.

5. The washing apparatus according to claim 4, wherein said fitting legs are integrally formed with the tub body.

6. The washing apparatus according to claim 5, wherein said fitting leg includes a reinforcement rib extending from one end thereof to the other, and the reinforcement rib has an engagement groove formed at the other end thereof to be engaged with the engagement portion of the pedestal.

7. The washing apparatus according to claim 1, which further comprises another pair of elongate fitting legs which are fixed to the tub body at one end and attached to the pedestal at the other end to support the tub body above the pedestal at a prescribed distance, and are arranged in the outer casing.

8. The washing apparatus according to claim 1, which further comprises an operation box which is provided with control members connected to the drive means, and is fitted to the tub body.

* * * * *